US007932838B2

(12) United States Patent
Hamza et al.

(10) Patent No.: US 7,932,838 B2
(45) Date of Patent: Apr. 26, 2011

(54) AIRCRAFT COLLISION AVOIDANCE SYSTEM

(75) Inventors: Rida Hamza, Maple Grove, MN (US); David Pepitone, Sun City West, AZ (US)

(73) Assignee: Honeywell International, Inc., Morristown, NJ (US)

( * ) Notice: Subject to any disclaimer, the term of this patent is extended or adjusted under 35 U.S.C. 154(b) by 367 days.

(21) Appl. No.: 12/272,472

(22) Filed: Nov. 17, 2008

(65) Prior Publication Data

US 2010/0123599 A1 May 20, 2010

(51) Int. Cl.
*G08B 21/00* (2006.01)

(52) U.S. Cl. ..... 340/958; 340/903; 340/905; 340/937; 340/945; 340/983; 340/988; 340/507; 348/143; 348/144

(58) Field of Classification Search ..... 340/958, 340/903, 905, 937, 945, 983, 988, 507; 348/143, 348/144

See application file for complete search history.

(56) References Cited

U.S. PATENT DOCUMENTS

| | | | | |
|---|---|---|---|---|
| 5,189,494 | A | 2/1993 | Muraki | |
| 5,278,764 | A | 1/1994 | Iizuka et al. | |
| 6,118,401 | A | 9/2000 | Tognazzini | |
| 6,218,961 | B1 | 4/2001 | Gross et al. | |
| 6,310,546 | B1 * | 10/2001 | Seta | 340/507 |
| 6,841,780 | B2 | 1/2005 | Cofer et al. | |
| 6,909,381 | B2 | 6/2005 | Kahn | |
| 7,176,440 | B2 | 2/2007 | Cofer et al. | |
| 7,583,817 | B2 * | 9/2009 | Kimura et al. | 382/104 |
| 2005/0007257 | A1 | 1/2005 | Rast | |

FOREIGN PATENT DOCUMENTS

WO WO2006027762 A1 3/2006

* cited by examiner

*Primary Examiner* — Tai T Nguyen
(74) *Attorney, Agent, or Firm* — P.G. Scott Born; Black Lowe & Graham PLLC

(57) ABSTRACT

A system for monitoring a volume of space surrounding an aircraft having a plurality of extremity portions includes a plurality of sensors. Each sensor is disposed at a respective corresponding one of the aircraft extremity portions. Each sensor is configured to generate an image of a monitored area covering a predetermined distance from the extremity portion at which the sensor is disposed. A processing device is configured to determine, from an image generated by a first sensor of the plurality, a characteristic of an object within the monitored area covering the predetermined distance from the extremity portion at which the first sensor is disposed. The processing device is further configured to generate a signal in response to determining the object characteristic.

16 Claims, 2 Drawing Sheets

AIRCRAFT COLLISION AVOIDANCE SYSTEM

BACKGROUND OF THE INVENTION

Although runway incursions are an NTSB top-ten safety issue, collisions that occur in the ramp, run-up, holding, and gate areas is a top-priority ramp safety and economic issue for the airlines. According to some figures, 43% of these collisions occur in the gate area, 39% in the gate entry/exit area, with the remaining in the ramp and taxiway areas. Conservative annual economic costs for aircraft damage (FSF, ATA, 1995) are approximately $4 billion for air carriers, $1 billion for corporate/business aircraft, with indirect costs (flight cancellation, repositioning, and aircraft out of service) at three times the direct damage costs. Currently there are no technologies available to provide the pilot with aided guidance while maneuvering the aircraft in tight quarters with structures, aircraft and other vehicles literally feet away. The pilot is required to taxi these large aircraft with an unaided eye.

Emerging technologies such as ADS-B & Multi-lateralization may help to positively identify aircraft position with a greater degree of accuracy but provide no information on the aircraft's shape footprint or the proximity of the aircraft's wings and tail to other structures. These emerging technologies will be of little help as an onboard maneuvering system where aircraft in the ramp area (such as an A380) must maneuver in close proximity to other wingtips, often with just feet to spare. Short of providing handlers for each and every aircraft at airports worldwide, an onboard maneuvering system is necessary to allow an aircraft to maneuver in spaces where the margins are measured in feet.

A secondary but no less important problem is the safety, security and surveillance of unattended or unoccupied aircraft. Security systems for aircraft, around the world, tend to be very unreliable and porous. The threat of hijacking of unsecured aircraft is on the rise which creates a market for additional, low cost aircraft security systems. Security systems are needed that can provide additional layers of security so that parked, unattended aircraft can be under surveillance with autonomous warning and alerting systems.

SUMMARY OF THE INVENTION

In an embodiment, a system for monitoring a volume of space surrounding an aircraft having a plurality of extremity portions includes a plurality of sensors. Each sensor is disposed at a respective corresponding one of the aircraft extremity portions. Each sensor is configured to generate an image of a monitored area covering a predetermined distance from the extremity portion at which the sensor is disposed. A processing device is configured to determine, from an image generated by a first sensor of the plurality, a characteristic of an object within the monitored area covering the predetermined distance from the extremity portion at which the first sensor is disposed. The processing device is further configured to generate a signal in response to determining the object characteristic.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

Figure 1:
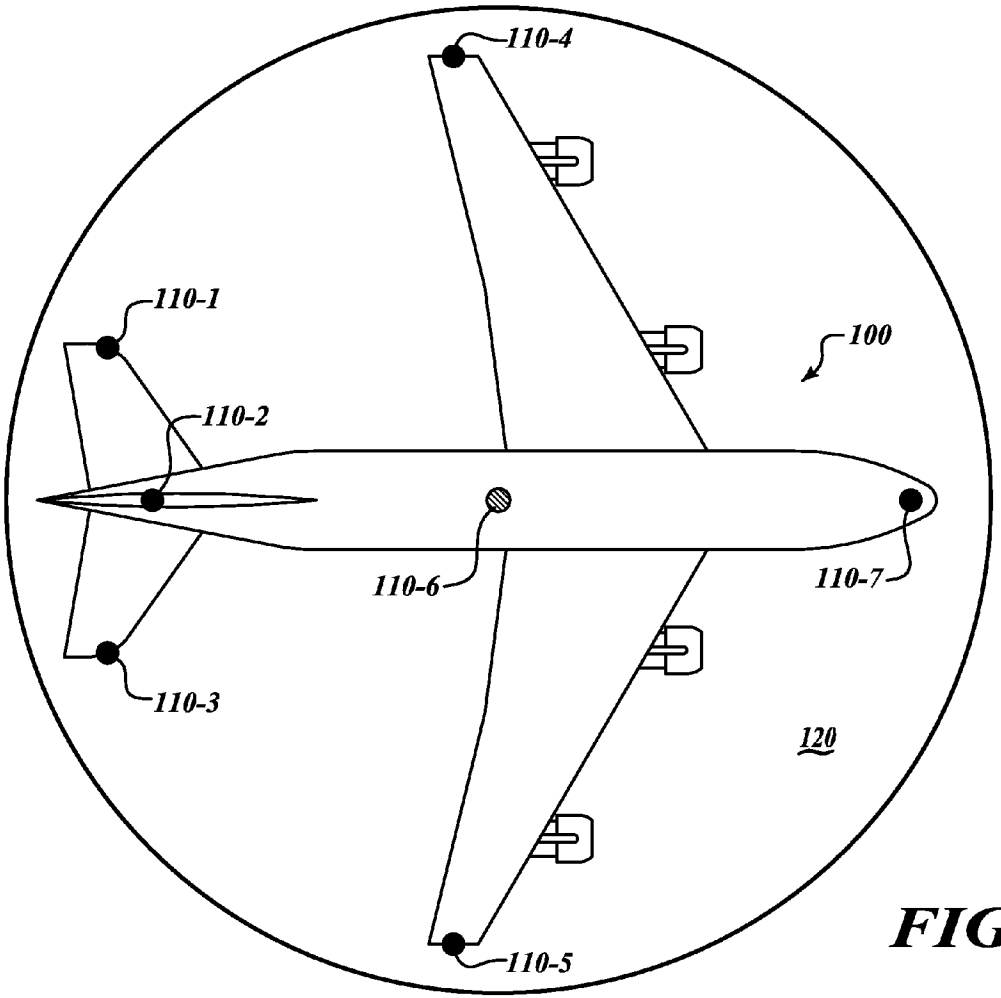
FIG. 1 illustrates a sensor-placement approach in accordance with an embodiment of the present invention.

Referring to FIG. 1, and according to an embodiment of the invention, illustrated is an approach to minimizing or eliminating the likelihood of collision of an aircraft 100 with obstacles in the vicinity of the aircraft. Detection sensors 110-1-110-7 are placed at points of extremity (i.e., those portions of the aircraft 100 most likely to collide with an obstacle) of the aircraft. For example, and as illustrated, sensors 110-1 and 110-3 may be placed on opposite sides of the aircraft vertical stabilizer, sensor 110-2 may be placed on the aircraft horizontal stabilizer, sensors 110-4 and 110-5 may be placed on the wing tips, sensor 110-6 (cross-hatched) may be placed on the bottom-most portion of the aircraft fuselage, and the sensor 110-7 may be placed on the nose of the aircraft. By placing the sensors 110-1-110-7 at the points of extremity and orienting the respective fields of view of the sensors, the arrangement illustrated in FIG. 1 offers a full 360-degree effective field of view 120 for the aircraft 100.

The sensors 110-1-110-7 each include an image capture apparatus (not shown) such as a video camera and an illumination apparatus (not shown) that enable the utilization of structured-light analysis for object detection and evaluation. The structure and function of the sensors 110-1-110-7, and principles under which they operate, incorporate concepts described in commonly owned U.S. Pat. No. 6,841,780, U.S. Pat. No. 7,176,440, U.S. patent application Ser. No. 10/465,267, and U.S. patent application Ser. No. 11/675,117, each of which is hereby incorporated by reference in its entirety as if fully set forth herein. In an embodiment, because a typical aircraft includes an exterior lighting system employing illuminating elements positioned at one or more of the points of extremity described above, the sensors 110-1-110-7 may be positioned close to such illuminating elements so as to use light emitted by the elements and be powered by the power source of the exterior lighting system.

Figure 2:
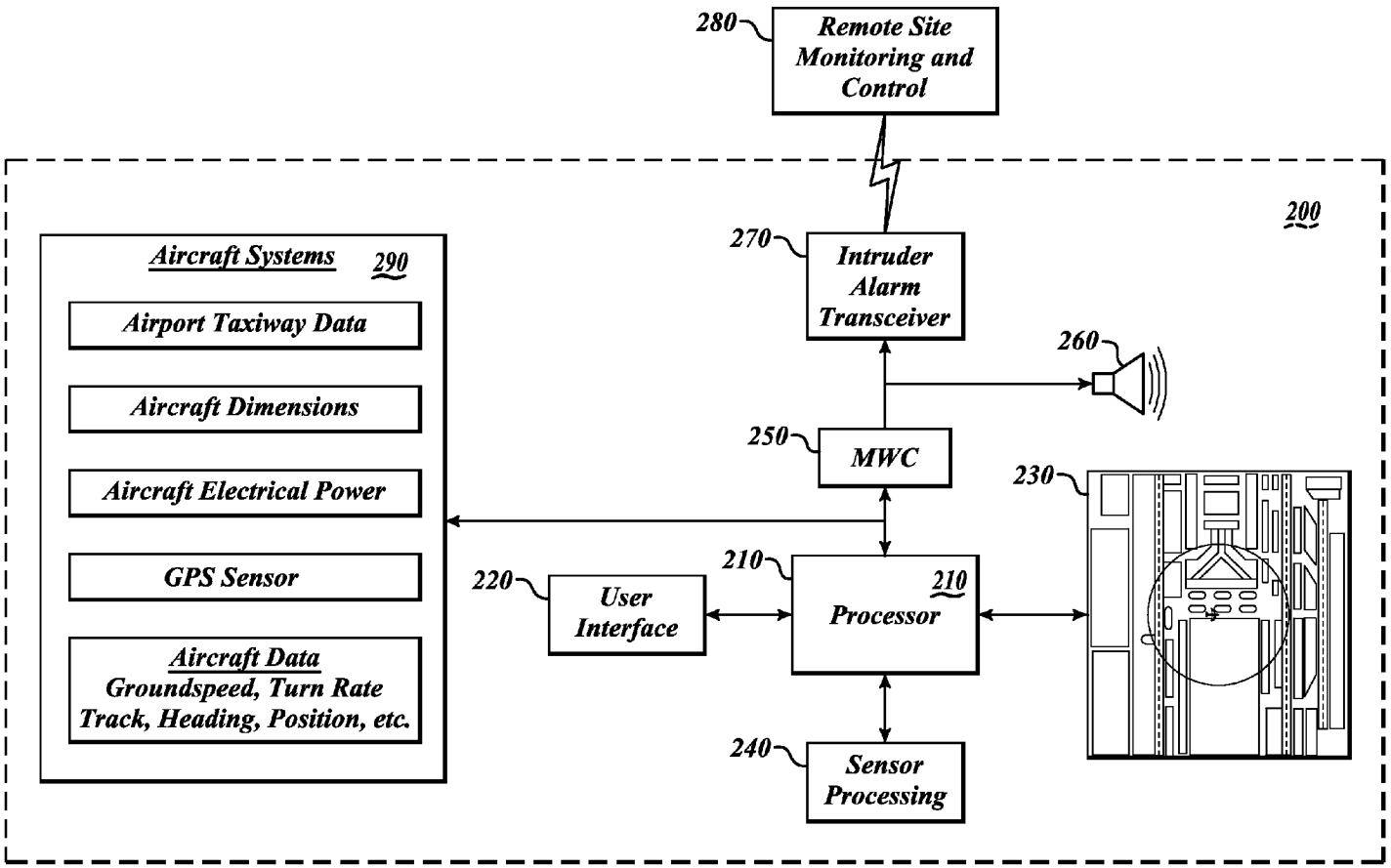
FIG. 2 illustrates an exemplary operating environment in accordance with an embodiment of the present invention.

FIG. 2 illustrates an example of a suitable operating environment in which an embodiment of the invention may be implemented. The operating environment is only one example of a suitable operating environment and is not intended to suggest any limitation as to the scope of use or functionality of the invention. Other well known computing systems, environments, and/or configurations that may be suitable for use with the invention include, but are not limited to, personal computers, server computers, hand-held or laptop devices, multiprocessor systems, microprocessor-based systems, programmable consumer electronics, network PCs, minicomputers, mainframe computers, distributed computing environments that include any of the above systems or devices, and the like.

The invention may be described in the general context of computer-executable instructions, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

The operating environment illustrated in FIG. 2 typically includes at least some form of computer readable media. Computer readable media can be any available media that can be accessed by one or more components of such operating environment. By way of example, and not limitation, computer readable media may comprise computer storage media and communication media. Computer storage media includes volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by one or more components of such operating environment. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer readable media.

Referring to FIG. 2, illustrated are components of a subsystem 200, the entirety of which may be onboard the aircraft 100, and that operates in conjunction with the sensors 110-1-110-7 to accomplish objectives in accordance with at least one embodiment of the invention. Subsystem 200 includes a processor 210 configured to generate a sensor-control user interface 220 to a display device, such as, for example, a cockpit display 230. The user interface 220 may be configured to allow the flight crew of the aircraft 100 to adjust the field of view of one or more of the sensors 110-1-110-7, and control the type and frequency of status messages and alarms pertaining to the sensors. The user interface 220 may further provide the flight crew a digital readout of the distance of a particular sensor 110 from a detected object and provide an indication of the location of the sensor and detected object with reference to a map of the aircraft's vicinity.

The subsystem 200 further includes a sensor-processing component 240, such as, for example, a processing card, that may be external to, or integral with, the processor 210. The component 240 may be configured to process images (e.g., raw camera data) received from the sensors 110-1-110-7 so as to determine movement of an object, range of an object from one or more of the sensors, and azimuth of the object relative to one or more of the sensors. This data can be used by the processor 210 to perform one or more predetermined tasks as described more fully below.

The subsystem 200 may also include a monitoring/warning component (MWC) 250 operable to generate an audio alarm to a cockpit speaker 260 in response to a determination by the processor 210 that a potentially hazardous object has been detected by the sensors 110-1-110-7 as approaching, or being approached by, the aircraft 100. In an embodiment, and in response to a determination by the processor 210 that a potentially hazardous object has been detected by the sensors 110-1-110-7 as approaching, or being approached by, the aircraft 100, the MWC 250 may also signal a transceiver (VHF, UHF, Mode S, or other) 270. The transceiver 270, in turn, may then transmit a signal to a remote site 280 monitoring the security of the aircraft 100, thereby providing an alert as to the presence of the hazardous object.

The subsystem 200 further includes aircraft systems components 290 that provide the processor 210 and/or other components of the subsystem electrical power, aircraft position, groundspeed, track/heading, and other stored data (e.g., airport surface structures and taxiway/ramp survey information). The taxiway/ramp and surface structures information may be part of an onboard database that would include location, orientation, dimensions, and signage associated with each of the structures or surface areas.

While a preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A system for monitoring a volume of space surrounding a vehicle having a plurality of extremity portions, the system comprising:

a plurality of sensors, each said sensor being disposed at a respective corresponding one of the vehicle extremity portions, each said sensor configured to generate an image of a monitored area covering a predetermined distance from the extremity portion at which the sensor is disposed; and at least one processing device configured to determine, from an image generated by a first sensor of the plurality, a characteristic of an object within the monitored area covering the predetermined distance from the extremity portion at which the first sensor is disposed, the processing device being further configured to generate a signal in response to determining the object characteristic, wherein each sensor comprises:

an image capture apparatus positioned to capture images of the monitored area; and an illumination apparatus placed to illuminate the monitored area with two or more wavelengths, wherein the illumination apparatus is adapted to project at least one different or offset pattern on the monitored area for each of the two or more wavelengths, wherein the volume of space monitored includes a volume corresponding to the space defined between the illumination apparatus and the monitored area, and wherein the volume of space monitored includes a volume corresponding to the space defined between the monitored area and the image capture apparatus.

2. The system of claim 1 wherein the characteristic comprises a range of the object from the extremity portion at which the sensor is disposed.

3. The system of claim 1 wherein the characteristic comprises an azimuth of the object relative to the extremity portion at which the sensor is disposed.

4. The system of claim 1 wherein the characteristic comprises movement of the object relative to the extremity portion at which the sensor is disposed.

5. The system of claim 1 wherein the image is wirelessly provided by the first sensor to the processing device.

6. The system of claim 1, further comprising a monitoring device positioned remotely from the vehicle and configured to receive the signal from the processing device.

7. The system of claim 1 wherein:

the vehicle includes a plurality of light-emitting elements disposed at the aircraft extremity portions, the light-emitting elements being powered by at least one power supply onboard the vehicle; and the plurality of sensors is powered by the at least one power supply.

8. The system of claim 1 wherein the plurality of extremity portions includes wing tips of the vehicle.

9. A method of monitoring a volume of space surrounding a vehicle having a plurality of portions, the system comprising:

positioning each of a plurality of sensors at a respective corresponding one of the vehicle portions, each said sensor configured to generate an image of a monitored area covering a predetermined distance from the portion at which the sensor is disposed; and computationally determining, from an image generated by a first sensor of the plurality, a characteristic of an object within the monitored area covering the predetermined distance from the portion at which the first sensor is disposed; and generating a signal in response to determining the object characteristic, wherein each sensor comprises:

an image capture apparatus positioned to capture images of the monitored area; and an illumination apparatus placed to illuminate the monitored area with two or more wavelengths, wherein the illumination apparatus is adapted to project at least one different or offset pattern on the monitored area for each of the two or more wavelengths, wherein the volume of space monitored includes a volume corresponding to the space defined between the illumination apparatus and the monitored area, and wherein the volume of space monitored includes a volume corresponding to the space defined between the monitored area and the image capture apparatus.

10. The method of claim 9 wherein the characteristic comprises a range of the object from the portion at which the sensor is disposed.

11. The method of claim 9 wherein the characteristic comprises an azimuth of the object relative to the portion at which the sensor is disposed.

12. The method of claim 9 wherein the characteristic comprises movement of the object relative to the portion at which the sensor is disposed.

13. The method of claim 9, further comprising wirelessly transmitting the image from the first sensor to a processing device, the processing device configured to perform the step of computationally determining the object characteristic.

14. The method of claim 13, further comprising receiving, with a monitoring device positioned remotely from the vehicle, the signal from the processing device.

15. The method of claim 9 wherein the vehicle includes a plurality of light-emitting elements disposed at the vehicle portions, the light-emitting elements being powered by at least one power supply onboard the vehicle; and further comprising powering the plurality of sensors with the at least one power supply.

16. The method of claim 9 wherein the plurality of portions includes wing tips of the vehicle.

* * * * *